US005697805A

United States Patent [19]

Orstad et al.

[11] Patent Number: 5,697,805

[45] Date of Patent: Dec. 16, 1997

[54] ALIGNMENT ASSIST SHROUD FOR AN ELECTRICAL CONNECTOR

[75] Inventors: Richard Edward Orstad, Greensboro; David Christopher Thomas, Kernersville, both of N.C.

[73] Assignee: The Whitaker Corporation, Wilmington, Del.

[21] Appl. No.: 708,282

[22] Filed: Sep. 6, 1996

Related U.S. Application Data

[60] Provisional application No. 60/005,637 Oct. 19, 1995.

[51] Int. Cl.[6] ..... H01R 13/629

[52] U.S. Cl. ..... 439/374

[58] Field of Search ..... 439/374, 701

[56] References Cited

U.S. PATENT DOCUMENTS

| | | | |
|---|---|---|---|
| 4,572,602 | 2/1986 | Rupnik | 339/65 |
| 4,722,698 | 2/1988 | Modschiedler | 439/374 |
| 4,738,637 | 4/1988 | Asick et al. | 439/610 |
| 4,842,543 | 6/1989 | Davis | 439/378 |
| 5,002,497 | 3/1991 | Plocek et al. | 439/248 |
| 5,037,323 | 8/1991 | Locati | 439/374 |
| 5,071,374 | 12/1991 | Plocek et al. | 439/752 |
| 5,080,604 | 1/1992 | Rider et al. | 439/680 |
| 5,125,849 | 6/1992 | Briggs et al. | 439/378 |
| 5,129,831 | 7/1992 | Locati | 439/79 |
| 5,147,225 | 9/1992 | Kile et al. | 439/680 |
| 5,147,226 | 9/1992 | Kile | 439/374 |
| 5,161,996 | 11/1992 | Locati | 439/374 |
| 5,211,585 | 5/1993 | Douty et al. | 439/680 |
| 5,356,300 | 10/1994 | Costello et al. | 439/378 |
| 5,391,091 | 2/1995 | Nations | 439/378 |
| 5,486,118 | 1/1996 | Colleran et al. | 439/374 |

OTHER PUBLICATIONS

Mini-Fit Family; Mini-Fit, BMI: Blind Mating Interconnect; Molex Catalog No. 930, pp. 12k and 13k.

*Primary Examiner*—Gary F. Paumen

[57] ABSTRACT

The invention comprises an electrical connector having a housing with a mating face, side walls, a top wall, and contact receiving cavities to receive electrical contacts therein. A pair of latching members are disposed along each of the side walls. An alignment shroud is removably mounted to the housing, the shroud having a forwardly facing angled surface extending forwardly and outwardly from a central portion of the shroud. A pair of latching legs extend rearwardly from the central portion, each of the latching legs having an opening wherein the latching members are received within the openings to secure the shroud to the housing. The central portion is secured along the mating face and the forwardly facing angled surface extend outwardly from the mating face to guide a matable connector into alignment with the contact receiving cavities.

13 Claims, 3 Drawing Sheets

ALIGNMENT ASSIST SHROUD FOR AN ELECTRICAL CONNECTOR

FIELD OF THE INVENTION

This application claims the benefit of U.S. Provisional Application(s) No.(s) 60/005,637, filed Oct. 19, 1995.

This invention relates to electrical connectors and an alignment and blind mate assist shroud for securing to an electrical connector to assist in aligning a complementary connector during mating of the two connectors as well as maintaining alignment of the complementary connector during unmating of the two connectors.

BACKGROUND OF THE INVENTION

An electrical connector can be provided with an alignment member. The alignment member typically has angled surfaces to direct a complementary connector into alignment with the electrical connector. These alignment members can either be integral with the electrical connector or can be a separate member which is secured onto the electrical connector.

U.S. Pat. No. 5,037,323 discloses an electrical header assembly having two separate alignment members that are secured on either end of the header assembly. These alignment members have angled surfaces to direct the complementary connector into alignment for proper mating with the electrical header assembly. These alignment members are secured on either end of the header assembly.

It would be an advantage to provide an alignment member which completely surrounds the electrical connector. It would also be an advantage to provide such an alignment member which can be added to an existing electrical connector.

SUMMARY OF THE INVENTION

The invention comprises an electrical connector having a housing with a mating face, side walls, and contact receiving cavities to receive electrical contact receiving cavities to receive electrical contacts therein. The contact receiving cavities extend from the mating face through the housing. A pair of latching members, one along each of the side walls, each of the latching members have a forwardly facing beveled surface and a rearwardly facing shoulder. An alignment shroud is removably mounted to the housing. The shroud has an alignment surface, the alignment surface has a forwardly facing angled surface extending forwardly and outwardly from a central portion of the shroud. A pair of latching legs extend rearwardly from the central portion, each of the latching legs have an opening wherein the latching members are received within the openings to secure the shroud to the housing. The central portion is secured along the mating face and the alignment surface extends outwardly from the mating face to guide a matable connector into alignment with the contact receiving cavities.

BRIEF DESCRIPTION OF THE DRAWINGS

Embodiments of the invention will now be described by way of example with reference to the accompanying drawings in which.

DETAILED DESCRIPTION OF THE INVENTION

Figure 1:
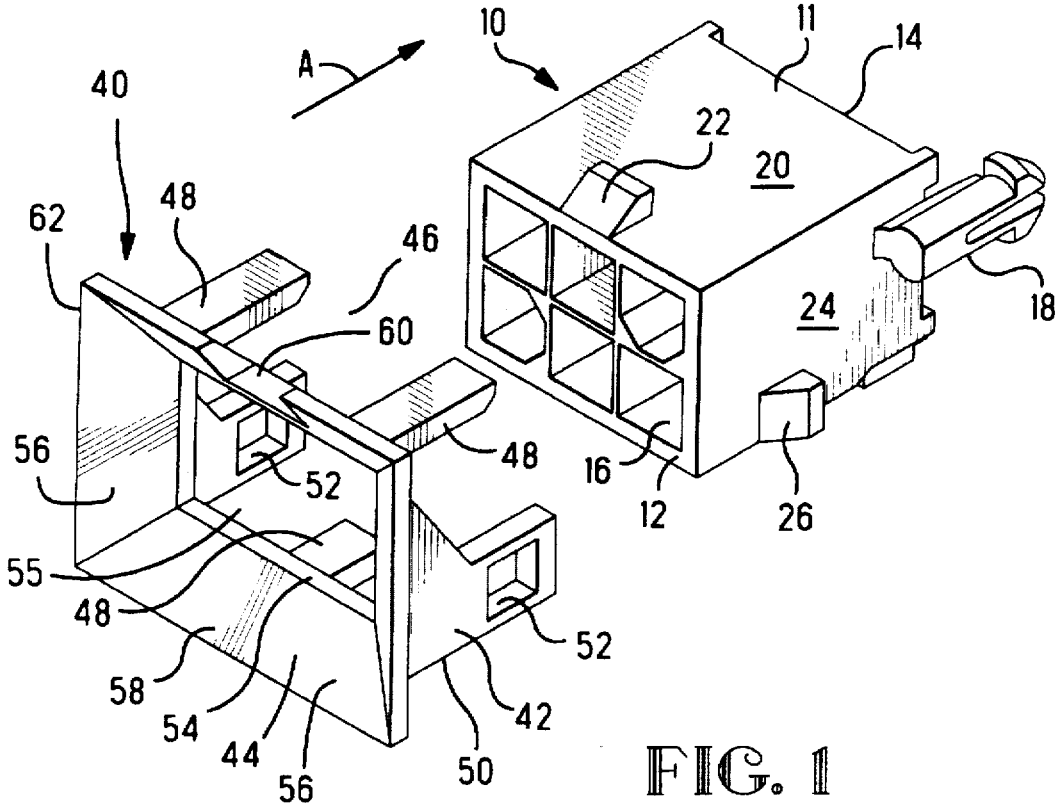
FIG. 1 is an exploded isometric view showing the alignment member and the electrical connector.

FIG. 1 shows the receptacle connector 10 having an alignment member in the form of a blind mate assist shroud 40 in accordance with the present invention. Electrical connector 10 has a housing 11 with a mating face 12 and a mounting face 14. Contact receiving cavities 16 extend from the mating face 12 to the mounting face 14 and are designed to receive electrical contacts (not shown) therein. The electrical connector is shown having a mounting member 18 to secure the connector to a panel such as a circuit board or some other panel. The electrical connector could also be a loose electrical connector having no mounting member 18 or being secured in some other manner. The connector 10 has a top wall 20 and sidewalls 24. The top wall has a latching projection 22 along the mating face. The latching projection 22 is used to secure the receptacle connector 10 with a matable connector (not shown) with a latching arm on the matable connector. The sidewalls 24 have ears 26 therealong. The ears 26 have a forwardly facing beveled surface and a rearwardly facing shoulder. The ears 26 are used to secure the blind mate assist shroud to the electrical connector. Along the mating face 12 is a forwardly facing peripheral section 28. Section 28 extends completely around the contact receiving cavity 16 and forms a forwardly facing ledge.

The blind mate assist shroud 40 includes a body 42 having a forward end 44 and a rearward end 46. A central peripheral portion 54 is centrally disposed between the forward and the rearward end. The central peripheral portion 54 extends around an opening 55 through which the mating face 12 if the connector 10 will be exposed. The rearward end 46 includes support bars 48 which extend rearwardly from the central peripheral portion 54 along the top and the bottom portion of the shroud. The rearward end also includes latches 50 which extend along either side of the blind mate assist shroud 40. This particular embodiment shows three such support bars, however, it would be possible to configure the shroud 40 with any number of support bars that would keep the shroud secured on the connector 10. The latch 50 extends rearwardly from the central peripheral portion 54 and has a opening 52 on its rearward most end. The latch is somewhat resilient to be able to secure the shroud 40 on the connector 10.

The forward end 44 of the shroud 40 has angled walls 56 with an outer periphery 62. The angled walls 56 extend from the outer periphery to the central peripheral portion 54. The angled walls are angled inwardly from the outer periphery. The forward end 44 also has rearwardly facing walls which are also angled parallel to the angled walls 56. It is from these rearwardly facing walls that the support bars 48 and the latches 50 extend.

Figure 5:
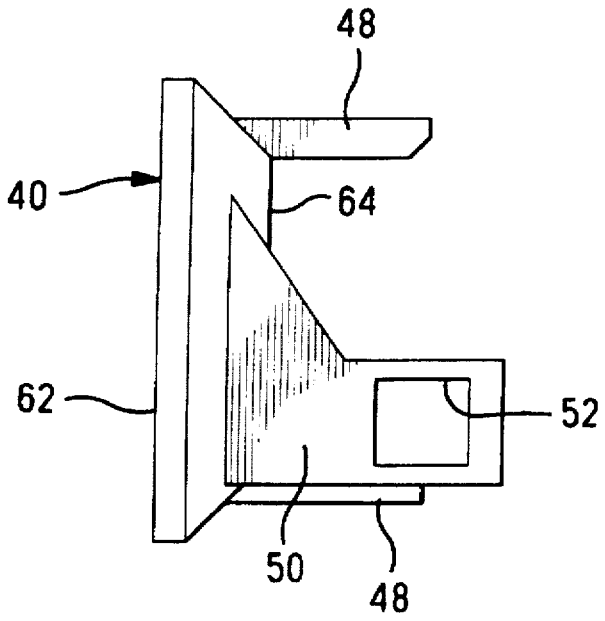
FIG. 5 is a side view of the alignment member.
Figure 6:
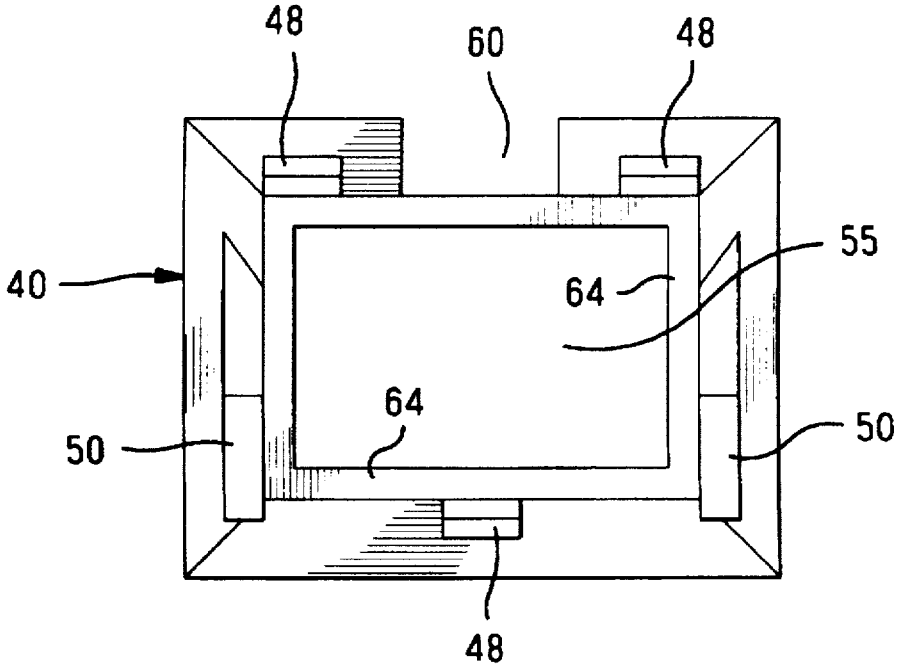
FIG. 6 is a rear view of the alignment member.

Along the central peripheral portion 54 there is a rearwardly facing ledge 64 as is shown in FIGS. 5 and 6. The rearwardly facing ledge 64 acts as a stop against the mating face of the receptacle connector 10. The angled wall 56 along the top portion of the shroud 40 has a latching opening 60. When the shroud is mounted onto the electrical connector 10, the latching opening 60 is aligned with the latch member 22.

Figure 2:
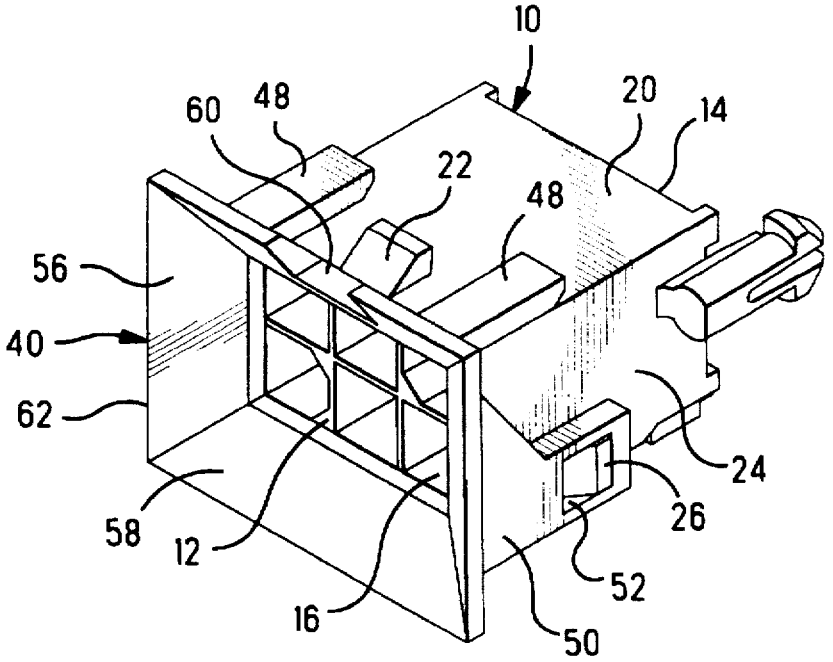
FIG. 2 is an isometric view showing the alignment member secured to the electrical connector.
Figure 3:
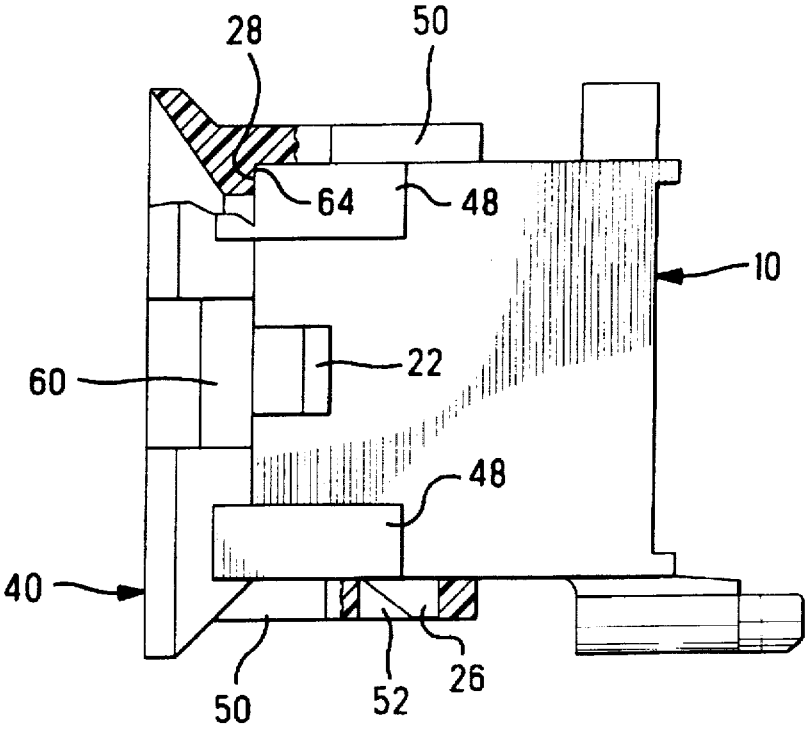
FIG. 3 is a top view showing the alignment member secured to the electrical connector.
Figure 4:
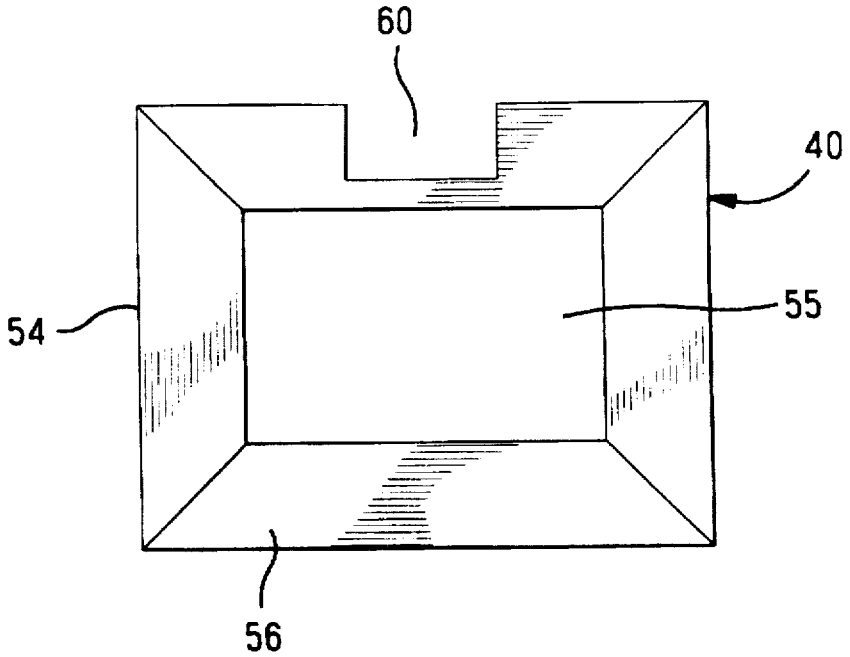
FIG. 4 is a top view of the alignment member.

The blind mate assist shroud 40 is mounted onto the receptacle connector 10 by moving the shroud 40 in the direction A as is shown in FIG. 1. In this representative embodiment, two support bars 48 are received along the top wall 20 of the receptacle connector 10. One support bar 48 is received along the bottom wall of the receptacle connector 10. The latches 50 are received along sidewalls 24 of the receptacle connector. The latches are deflected outwardly by the forwardly facing beveled surface of the ear 26. When the ear 26 is received within the opening 52, the latches 50 resile back into their original position and are therefore secured along the rearwardly facing shoulder of the ear 26 as is show in FIG. 2 and in FIG. 3. The rearwardly facing ledge 64 is received along the forward periphery 28 of the receptacle connector. The ledge 64 is of a dimension such that it completely covers the forward periphery 28 thereby leaving only the contact receiving cavities 16 exposed through the central opening 55 in the shroud 40. That is, the ledge 64 and the periphery 28 are approximately the same size. The support bars 48 are received on either side of the connector 10 to secure and stabilize the shroud to the connector. The support bars prevent the shroud from moving up and down or in an angular motion while mounted onto the connector.

When the shroud 40 is mounted onto the connector 10, the angled walls 56 will serve to align and direct the matable connector. If the matable connector is not in alignment either up, down, or side to side, the walls will direct the matable connector into proper alignment with the contact receiving cavities 16. The latching opening 60 receives the latch from the matable connector (not shown) so that the latch can then engage the latching projection 22 on the receptacle connector thereby securing the matable connector with the receptacle connector 10.

This alignment feature of the shroud is very important when the connector is mounted on a circuit board, or in some position that is not visible to the user. When this occurs, the user has to blind mate the connectors because he cannot see how they should be aligned. The angled walls on the shroud will direct the complementary connector into proper alignment so that contacts are not damaged during insertion of the complementary connector. The shroud can also serve as a polarizing member because the latch on the matable connector can only be received through the opening 60. If the complementary connector is improperly oriented, the latch arm on the complementary connector will abut against the angled walls and therefore the user will be alerted to the fact that the complementary connector is improperly oriented. The alignment shroud 40 can be secured onto any existing electrical connector having the mounting ears 26. The alignment shroud 40 can be made in different sizes so that it can be secured onto different size connectors.

One representative example of a receptacle connector 10 and the shroud 40 have been shown herein. However, it is to be understood that many different forms of the receptacle connector 10 can be used and a shroud 40 can be designed using the concepts herein which will completely surround the connector to guide a matable connector into proper alignment therewith.

It is thought that the electrical connector and blind mate assist shroud of the present invention and many of its intended advantages will be understood from the foregoing description. It is apparent that various changes may be made in the form, construction, and arrangement of parts thereof, without departing from the spirit or scope of the invention without sacrificing all of its material advantages.

We claim:

1. An electrical connector, comprising:

a housing having a mating face, side walls, and contact receiving cavities to receive electrical contacts therein, the contact receiving cavities extending from the mating face through the housing;

a pair of latching ears, one along each of the side walls, each of the latching ears having a forwardly facing beveled surface and a rearwardly facing shoulder;

an alignment shroud removably mounted to the housing, the shroud having an alignment surface, the alignment surface having a forwardly facing angled surface extending forwardly and outwardly from a central portion of the shroud, a pair of latching legs extending rearwardly from the central portion, each of the latching legs having an opening wherein the latching ears are received within the openings to secure the shroud to the housing, the central portion being secured along the mating face and the alignment surface extending outwardly from the mating face to guide a matable connector into alignment with the contact receiving cavities;

wherein the shroud has support bars which extend rearwardly from the central portion along a top and a bottom of the shroud, the support bars being received along exterior surfaces of top and bottom walls of the housing to support the shroud when mounted to the housing and to prevent angular movement of the shroud on the housing.

2. The electrical connector of claim 1, wherein the housing has a second latching member along a top wall of the housing, the second latching member having a forwardly facing ramped surface and a rearwardly facing shoulder, the alignment surface of the shroud having an opening which is aligned with the second latching member when the shroud is mounted to the housing, whereby a latching arm on the matable connector is receivable through the opening on the alignment surface to latchably secure the matable connector with the housing.

3. The electrical connector of claim 1, wherein the alignment surface comprises four walls extending from the central portion outwardly to an outer periphery, the central portion having an opening through which the mating face of the housing is exposed when the shroud is mounted to the housing, the four walls completely extending around the mating face of the connector.

4. The electrical connector of claim 3, wherein the central portion has a rearwardly facing ledge, the mating face has an outer periphery which extends around the contact receiving cavities, the rearwardly facing ledge being received against the mating face and covering the outer periphery such that the matable connector is guided into alignment with the contact receiving cavities of the housing.

5. The electrical connector of claim 1, wherein the housing has a mounting member, including two cantilevered legs, to mount the housing to a panel.

6. The electrical connector of claim 1, wherein the central portion of the shroud surrounds an opening through which the mating face of the housing is exposed when the shroud is mounted on the housing.

7. The electrical connector of claim 6, wherein the opening is a rectangular shape, the alignment surface comprises four walls extending outwardly from the central portion to an outer periphery, the outer periphery being rectangular shaped.

8. An electrical connector, comprising:

a housing having a mating face, side walls, and contact receiving cavities to receive electrical contacts therein, the contact receiving cavities extending from the mating face through the housing;

a pair of latching ears, one along each of the side walls, each of the latching ears having a forwardly facing angled surface and a rearwardly facing shoulder;

an alignment member being removably mountable to the mating face of the housing, the alignment member having a central portion with an aligning surface extending forwardly therefrom, the alignment surface having forwardly facing angled surfaces extending from the central portion, a pair of latching members extending from the central portion to engage one of the latching members thereby securing the alignment member to the housing, the central portion of the alignment member being secured along the mating face and the alignment surface extending forwardly therefrom to guide a matable connector into proper alignment therewith;

wherein the shroud has support bars which extend rearwardly from the central portion along a top and a bottom of the shroud, the support bars being received along exterior surfaces of top and bottom walls of the housing to support the shroud when mounted to the housing and to prevent angular movement of the shroud on the housing.

9. The electrical connector of claim 8, wherein the housing has a second latching member along top wall of the housing, the second latching member having a forwardly facing ramped surface and a rearwardly facing shoulder, the alignment surface of the shroud having an opening which is aligned with the second latching member, whereby a latching arm on the matable connector is receivable through the opening on the alignment surface to latchably secure the matable connector with the housing.

10. The electrical connector of claim 8, wherein the alignment surface comprises four walls extending from the central portion outwardly to an outer periphery, the central portion having an opening through which the mating face of the housing is exposed when the shroud is mounted to the housing, the four walls completely extending around the mating face of the connector.

11. The electrical connector of claim 10, wherein the central portion has a rearwardly facing ledge, the mating face has an outer periphery which extends around the contact receiving cavities, the rearwardly facing ledge being received against the mating face and covering the outer periphery such that the matable connector is guided into alignment with the contact receiving cavities of the housing.

12. The electrical connector of claim 8, wherein the housing has a mounting member, including two cantilevered legs, to mount the housing to a panel.

13. The electrical connector of claim 8, wherein the latching member comprises a latching leg which extends rearwardly from the central portion of the shroud, the latching member having an opening at an end opposite to the central portion, the opening receiving the latching ear therein to secure the shroud to the housing.

* * * * *